US009784550B2

(12) United States Patent
Ohlson

(10) Patent No.: US 9,784,550 B2
(45) Date of Patent: Oct. 10, 2017

(54) BLAST-RESISTANT CONTAINER

(71) Applicant: Dynasafe Protection Systems AB, Karlskoga (SE)

(72) Inventor: Fredrik Ohlson, Torslanda (SE)

(73) Assignee: DYNASAFE PROTECTION SYSTEMS AB, Karlskoga (SE)

( * ) Notice: Subject to any disclaimer, the term of this patent is extended or adjusted under 35 U.S.C. 154(b) by 0 days.

(21) Appl. No.: 15/314,085

(22) PCT Filed: Mar. 23, 2015

(86) PCT No.: PCT/EP2015/056129

§ 371 (c)(1),
(2) Date: Nov. 27, 2016

(87) PCT Pub. No.: WO2015/180857

PCT Pub. Date: Dec. 3, 2015

(65) Prior Publication Data

US 2017/0219329 A1 Aug. 3, 2017

(30) Foreign Application Priority Data

May 28, 2014 (EP) ..... 14170359

(51) Int. Cl.
*F42D 5/045* (2006.01)

(52) U.S. Cl.
CPC ..... *F42D 5/045* (2013.01)

(58) Field of Classification Search
CPC ... F42D 5/04; F42D 5/045; F41H 5/24; B65D 90/325; F42B 39/00; F42B 39/14; F42B 39/22; F42B 39/24; F42B 39/26; E05B 65/00; E05B 65/006; E05B 65/0075; E05B 65/0082
See application file for complete search history.

(56) References Cited

U.S. PATENT DOCUMENTS 5,067,755 A * 11/1991 James ..... E05B 65/0075 109/59 R
5,312,182 A * 5/1994 Mlakar ..... B65D 88/005 312/140
5,595,431 A 1/1997 Mlakar
(Continued)

FOREIGN PATENT DOCUMENTS

| | | |
|---|---|---|
| EP | 461336 | 12/1991 |
| KR | 20120066486 | 6/2012 |
| WO | 03/010488 | 12/2002 |

OTHER PUBLICATIONS

Maarten Giesen, International Search Report, parent PCT Application No. PCT/EP2015/056129, dated Aug. 20, 2015, European Patent Office, Rijswijk, NL.

*Primary Examiner* — Benjamin P Lee
(74) *Attorney, Agent, or Firm* — Babcock IP, PLLC

(57) ABSTRACT

The present invention relates to a blast-resistant container, and particularly to such a container configured to receive an explosive, an explosive-suspect item or a thereto related article for preventing or minimizing damage in the event an explosion occurs. Advantages with the invention includes for example an improved safety situation surrounding the process of handling potentially explosive devices, as the blast-resistant container may be made readily available for use in any situation where potentially dangerous objects may be presented.

13 Claims, 5 Drawing Sheets

(56) References Cited

U.S. PATENT DOCUMENTS

| | | | | |
|---|---|---|---|---|
| 5,599,082 | A * | 2/1997 | Mlakar | B65D 88/005 220/1.5 |
| 6,196,107 | B1 | 3/2001 | Hoffman | |
| 6,918,501 | B2 * | 7/2005 | Wang | B65D 88/14 220/1.5 |
| 8,800,797 | B2 * | 8/2014 | Fingerhut | B65D 85/00 220/1.5 |
| 2012/0312147 | A1 | 12/2012 | Abbe | |
| 2014/0008358 | A1 * | 1/2014 | Fingerhut | B65D 85/00 220/1.5 |

* cited by examiner

BLAST-RESISTANT CONTAINER

TECHNICAL FIELD

The present invention relates to a blast-resistant container, and particularly to such a container configured to receive a possibly suspected explosive item or a thereto related article for preventing or minimizing damage in the event an explosion occurs.

BACKGROUND OF THE INVENTION

Various blast-resistant containers have been developed and used for carrying a general explosive device, such as an improvised explosive device (IED) or homemade bomb, to a place where it can be safely detonated, or to permit its safe detonation within the container itself. The known blast-resistant containers presently in use are generally of very thick, heavy and bulky construction in order to be able to withstand the blast should the article placed within it explode. There exist basically three type of design, the first being a cylindrical container open at both ends which vents the explosive gases from a detonation through the ends and provides protection from fragmentation only on the side, the second being a cylinder similar to the first type, however being open only on the top end and providing added protection from fragments at the bottom end. The third type is an essentially spherical container which totally contains the fragments and the blast. The spherical container offers the best protection, but requires an opening with a very complex and expensive door.

In general, the above discussed types of blast-resistant containers are typically, by their very nature, large and heavy, and construction thereof is costly and labor intensive. Accordingly, they are too expensive for dedicated installation at a particular site. In addition, many organizations are unwilling to make the necessary investments in view of the relative infrequency of any bomb threats. Moreover, size and weight characteristics impede conveyance of the prior art types of blast-resistant containers from a remote location to the vicinity of a package bomb. Many buildings entrances, decks and freight elevators cannot accommodate or support such large and heavy equipment. Thus, the prior art types of blast-resistant containers tend to significantly increase exposure and handling of a suspect explosive device before safe isolation thereof can be established. Evacuation of an entire facility, pending arrival of a transportable bomb containment container, is often the only viable option.

Accordingly, a need exists for a novel type of blast-resistant container, which may be designed and manufactured at a lower cost as compared to the prior art types of containers, thus making it more suitable for general installation for minimizing the risk of personnel coming in contact with suspect explosive devices

SUMMARY OF THE INVENTION

In view of the above mentioned need, a general object of the present invention is to provide an improved blast-resistant which at least to some extent provides further improvements in relation to prior art.

According to an aspect of the invention, there is provided a blast-resistant container, comprising a chamber having an opening, the chamber configured to receive an explosive device and being constructed from a material configured to safely contain fragments and a blast pressure in case of explosion of the explosive device, and an external door configured to cover the opening in a closed position and to allow access to the inside of the body in an open position, the door comprising a door leaf having an upper first door side and a second lower door side provided at a circumference of the door leaf, the second door side being essentially opposite to the first door side, wherein the opening is provided with an angled locking flange arranged at an upper first opening side and a lower second opening side provided at a circumference of the opening, the second opening side being essentially opposite to the first opening side, and the first and the second door sides are provided with locking elements angled in an opposite direction to the locking flanges and configured to allow corresponding engagement with the locking flanges at the first and the second opening sides, respectively, allowing the door to slide from the open position to the closed position.

In accordance with the present invention, there is provided an explosion resistant container suitable for containing the effects of a bomb explosion within the container. The container includes a chamber and an externally arranged door that can slide from an open to a closed position. The container is manufactured from an explosion resistant material, typically a metal material, having an opening configured to receive the possible bomb, and as mentioned, configured to be covered by the door.

The chamber is constructed in such a way that at least an upper side and a lower side of the opening is provided with an angled locking flange configured to engage with corresponding and in an opposite direction angled locking elements provided at the door. The inventor has identified this implementation to be specifically suitable from a safety as well as from a manufacturing perspective, possibly lowering the bar for acquiring such a blast-resistant container for use in everyday situations such as for example in relation to a sorting facility, post office, etc. due to the possibility of manufacturing the blast-resistant container to be less heavy and more flexible in terms of as compared to prior-art containers.

Thus, advantages with the invention includes for example an improved safety situation surrounding the process of handling potentially explosive devices, as the blast-resistant container may be made readily available for use in any situation where potentially dangerous objects may be presented.

Preferably, the blast-resistant container further comprises a door support configured to receive the door leaf in the open position. Specifically, the door support may be arranged in such a manner as compared to the chamber such that the door leaf may be slid over to the door support once in the open position. Thus, it is desirable to arrange the elements of the door support as an extension of the locking flange provided at the opening. The door support may in a preferred embodiment be hinged to the chamber, thus making it possible to store away the door support once the door is in the closed position. Similarly, also once the door leaf is fully arranged at the door support in the open position, both the door leaf and the door support may be securely stored away. This is specifically advantageous in case of an in comparison large blast-resistant container, e.g. having a door leaf having a weight that normally may be considered to exceeding what is suitable to manually lift (such as above 20 kg). However, it may of course be possible to construct the container in such a way that the door leaf has an in comparison lower weight, thus making the door support optional.

In a preferred embodiment, the locking elements provided at the first and the second door sides are formed from separate elongated structural material fixed parallel to the first and the second door sides. Preferably, an angled elongated metal beam may be affixed to the door leaf for providing this functionality. The elongated beam may for example be welded to the door leaf, or alternatively connected to the door leaf using bolting. Other possibilities exits and are within the scope of the invention.

It is advantageous to provide the door leaf with a plurality of teeth shaped protrusions at the first and the second door sides at the circumference of the door leaf. These teeth shaped protrusions are then configured to be "inserted" into corresponding openings of the respective elongated metal beams, preferably through the openings where they are affixed, for example using welding. In an embodiment, 2-5 teeth are formed per 100 cm of side of the door leaf. It may of course be possible to include further or less teeth per 100 cm.

In a preferred embodiment, the door leaf and the plurality of teeth shaped protrusions are formed from a single sheet metal element. In such an embodiment, the door leaf may be laser cut or otherwise shaped for forming the teeth.

The door leaf typically provided with a third and a fourth vertical side, the third and the fourth sides are provided with a further plurality of teeth shaped protrusions formed at the circumference of the door leaf, and a further elongated locking element is fixed at the third door side, the further elongated locking element having correspondingly arranged openings for receiving the plurality of teeth shaped protrusions of the third side of the door leaf. Thus, also the third side will be provided with an elongated locking element that typically may be engaged with a corresponding locking flange at the opening of the opening, i.e. two angled elements engaging with each other at each of the three sides. Thus, the door will be locked to the chamber at three sides once the door is in the closed position.

The angled locking flange arranged at the opening is preferably formed from separate structural elements and being fixed to the chamber. Thus, the interface between the chamber and the door may be manufactured separately and affixed to the chamber. The locking flange is preferably welded to the opening of the chamber.

As such, the blast-resistant container may typically be arranged in a general cube shape, having six rectangular sides not necessarily being of the exact same size, where the door leaf forms one of said six rectangular sides. The chamber is preferably also formed from a sheet metal element, advantageously having a thickness of at least 20 mm.

For providing an even further secure locking the door to the chamber, e.g. for increasing the connection between the door and the chamber once the door is in its closed position and/or to refrain from unauthorized or unintentional opening of the door and for, the blast-resistant container may further be provided with a locking arrangement fixed to a vertical side of the door opening corresponding to the fourth vertical side of the door leaf. Preferably, the locking arrangement is configured to engage and lock with the plurality of teeth shaped protrusions formed at the fourth vertical side of the door leaf when the door is arranged in the closed position. Such teeth shaped protrusions may also be provided at the fourth side of the locking flange, thus also engaging with the locking arrangement once the door is arranged at its closed position.

For improving the handling of the container, it may be possible to equip the blast-resistant container with a sliding rail fixed at the second opening side and configured to reduce an amount of friction when sliding the door between the opened and the closed position. Such a sliding rail may also be correspondingly provided at the first upper opening side.

It is preferred to arrange the container according to the invention to be mobile. Accordingly, the container may be affixed to a carriage, possibly allowing the carriage to be readily connected to a vehicle of any sort for quickly moving the container away from any personnel in case of a possible explosive device being arranged in the container.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
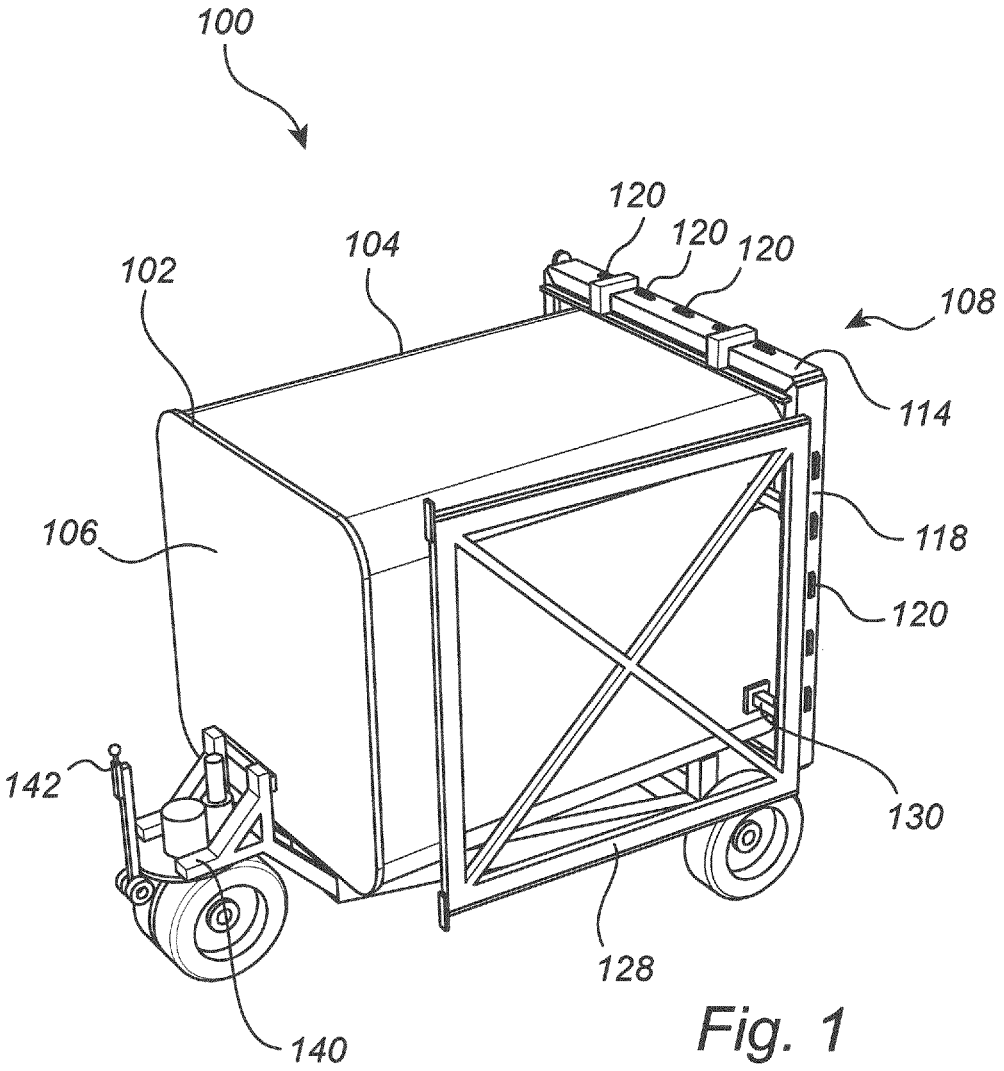
FIG. 1 conceptually illustrates a perspective view of a blast-resistant container according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Figure 2A:
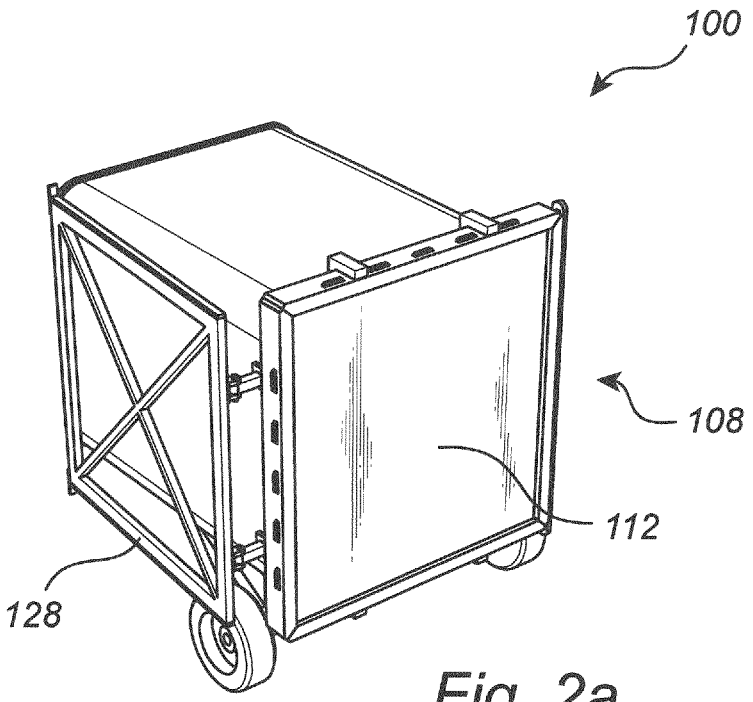
FIG. 2*a*-2*e* shows detailed view of the door and locking mechanism provided in relation to the inventive container.
Figure 2B:
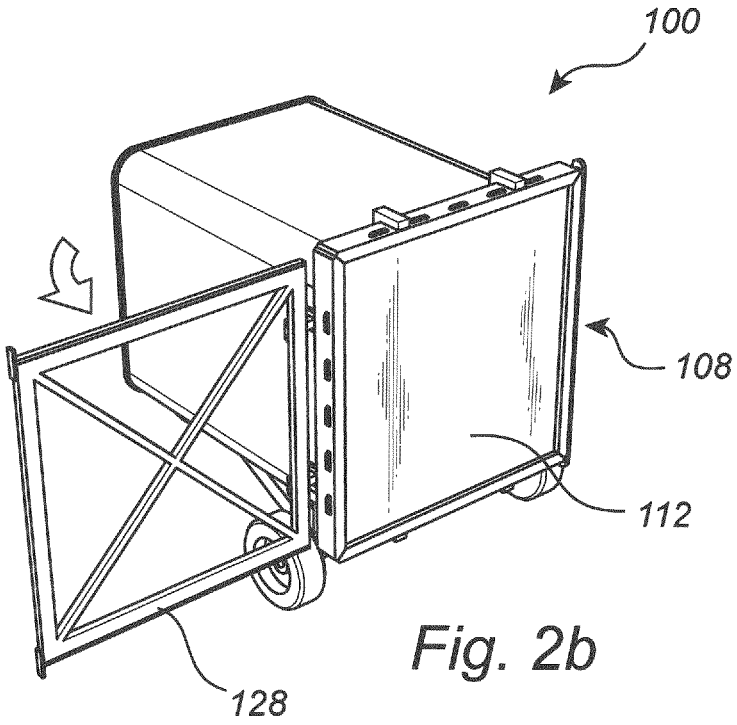
Figure 2C:
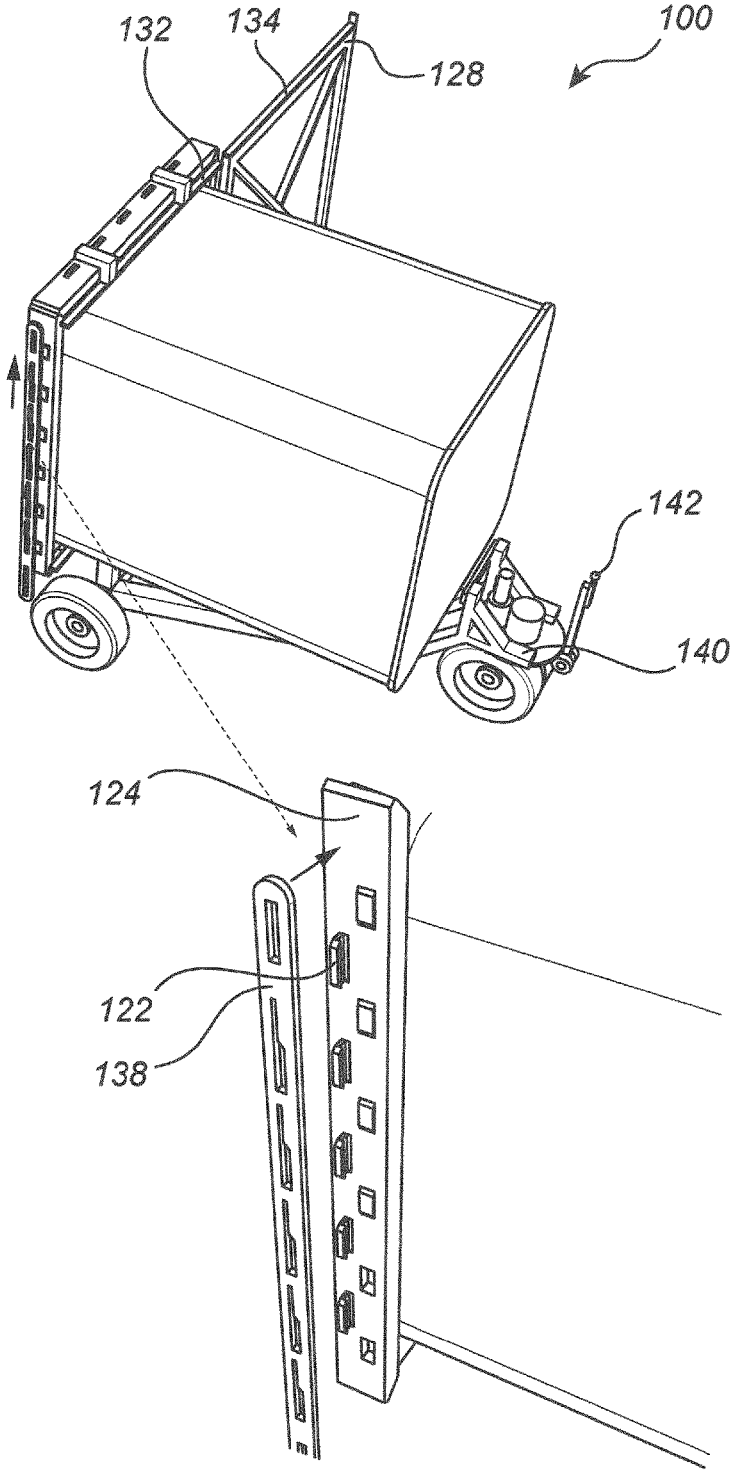
Figure 2D:
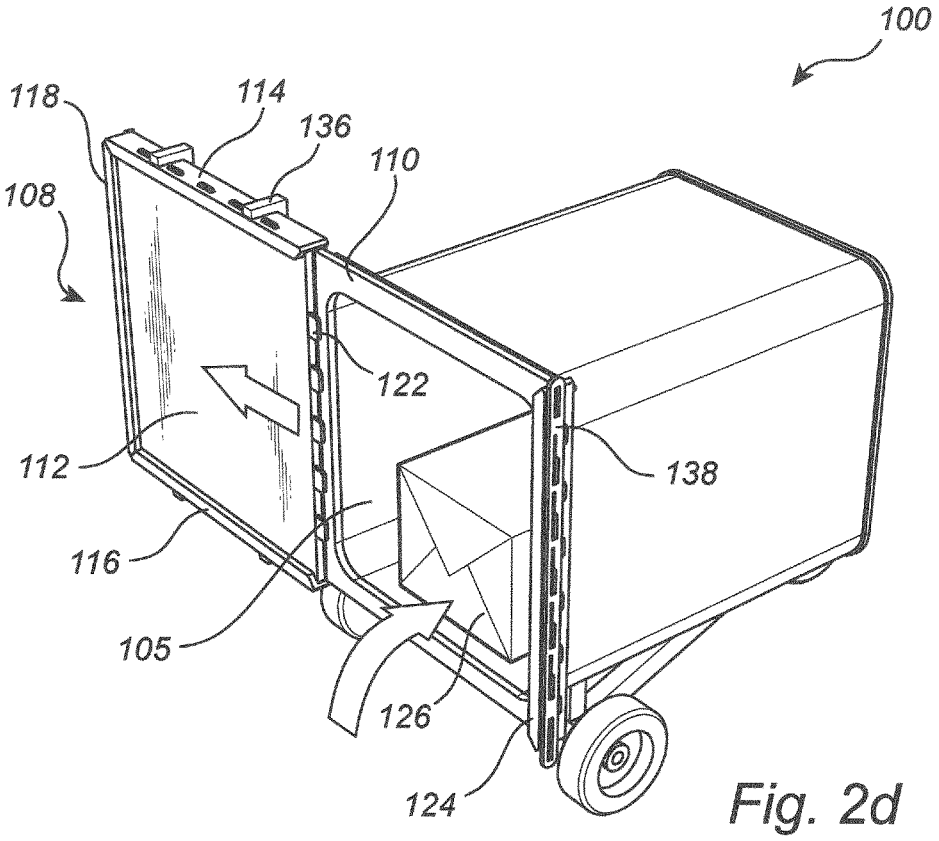
Figure 2E:
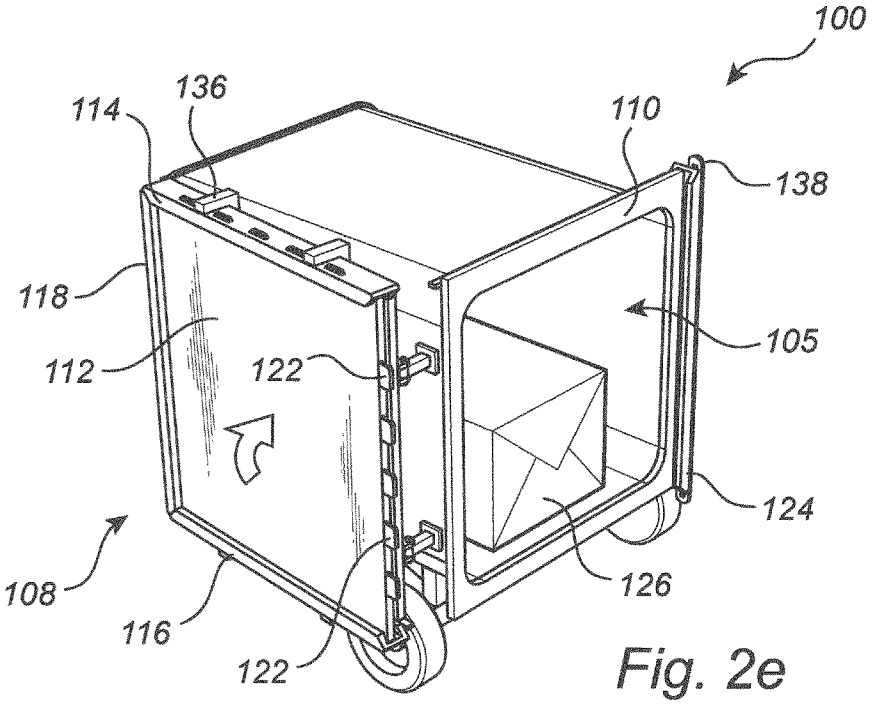
Figure 3:
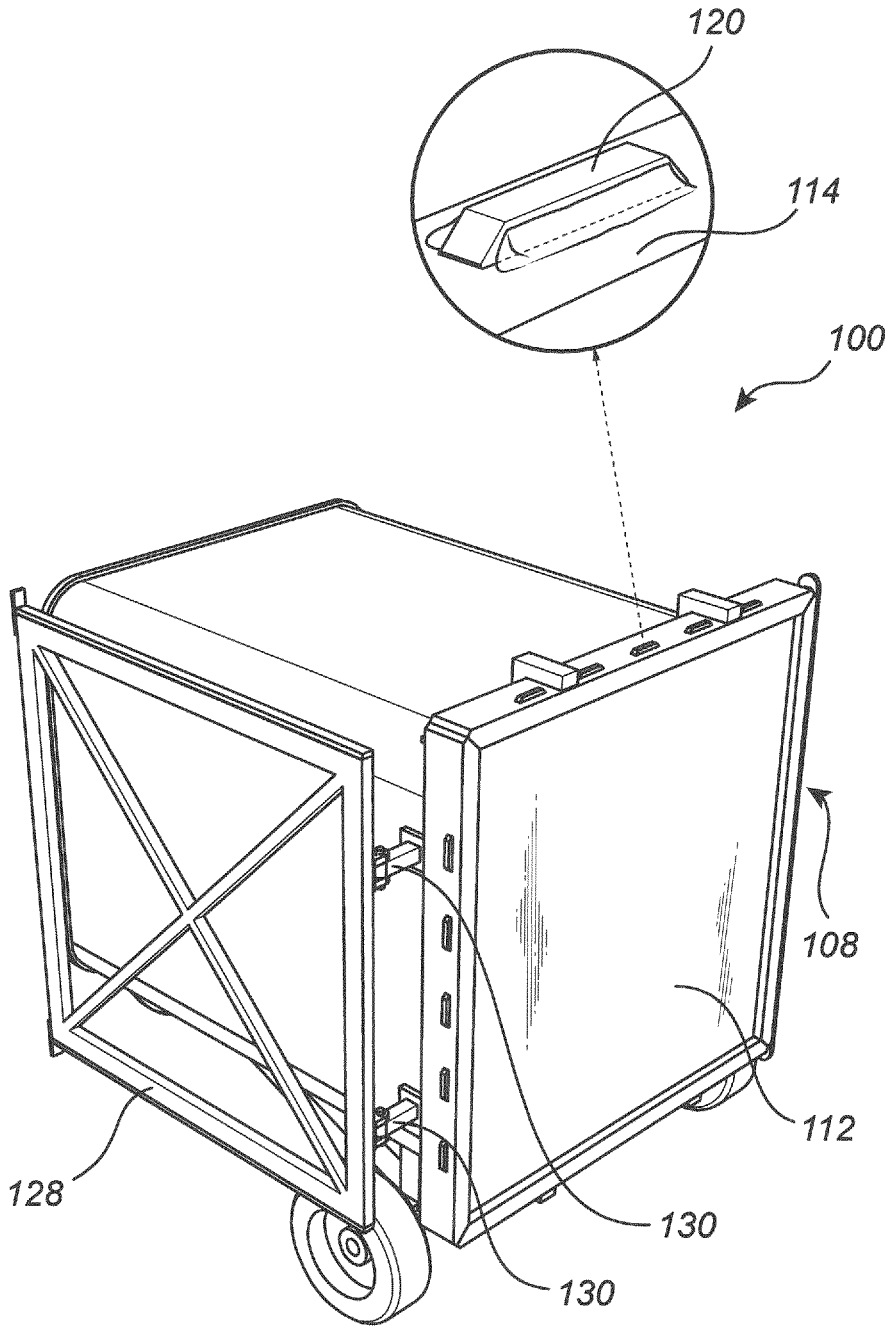
FIG. 3 shows a detailed illustration of an exemplary joint between a door leaf and a locking beam provided in relation to a currently preferred embodiment of the inventive container.

Referring now to the drawings, where FIGS. 1-3 in conjunction depict a conceptual illustration of a blast-resistant container 100 according to a currently preferred embodiment of the invention.

The blast-resistant container 100 comprises a chamber 102, typically being an essentially rectangular prism of a welded construction. The chamber 102 comprises a main body 104 enclosing four of the sides of the chamber 102 and a back portion 106 for example being welded to the main body 104. The main body 104 as well as the back portion 106 may be constructed from a sheet metal plate, where the main body 104 for example may be made formed from a single piece of material resulting in only a single joining weld. Alternatively, the main body 104 may be formed by a plurality of pieces of metal being joined together.

At a front end of the blast-resistant container 100 there is provided an opening 105, provided with an external door 108 to be transitioned from an open to a closed position (or held in either of these positions). The opening 105 and the external door 108 typically have a corresponding rectangular form. The opening 105 is provided with a locking flange 110 extending perpendicular to and around the circumference of the opening 105. It would be possible, and within the scope of the invention, to provide a plurality of "segmented" locking flanges arranged at the circumference of the opening 105, however not necessarily provided at all four sides of the opening 105.

The external door 108 comprises a door leaf 112 and locking beams 114, 116, 118 (typically provided by beams having a U-shaped cross section) arranged at the circumference of the door leaf 112, at the upper, lower and at one of the sides of the circumference of the door leaf 112, respectively. The locking beams 114, 116, 118 are securely engaging with its respective sides of the door leaf 112 in a "two step manner". Firstly, the bottom (typically denoted as the "web") of the U-shaped locking beams 114, 116, 118 are provided with "opening", into which corresponding protrusions 120 extending at the circumference of the door leaf 112 are allowed to be inserted. FIG. 3 provides a detailed illustration where the protrusions 120 are configured to extend into the openings and through the material forming the locking beams 114, 116, 118, typically of a metal material. Secondly, at least an outer portion of the protrusions 120 are welded at and around the respective openings of the locking beams 114, 116 and 118.

As an example and in regards to the locking beam 114 arranged at the upper side of the circumference of the door leaf 112, this will be implemented by arranging the locking beam 114 "upside down" in regards to its U-shape, where the protrusions 120 at the corresponding side of the door leaf 112 will be extending through the web material of the locking beam 114 and be welded at the outside of the locking beam 114 (again, see the detailed illustration provided in FIG. 3). The further locking beams 116, 118 may be arranged in a similar manner (locking beam 116 being arranged at the bottom of the door leaf 112 and the locking beam 118 arranged at the side of the locking beam 112). The locking beams 114, 116, 118 may (alternatively or) also be connected to the door leaf 112 by means of additional welds and/or further joints, such as for example using a bolting joint.

The U-shaped locking beams 114, 116, 118 are further formed to have a width between the beam flanges (typically denoted as a beam height) allowing also a portion of the locking flange 110 to together with the door leaf 112 be arranged between the flanges of the respective locking beams 114, 116, 118. As understood, this will typically be applicable once the door 118 is arranged in its closed position, where the locking flange 110 will be arranged essentially in parallel with the door leaf 112. In an embodiment of the invention, the locking flange 110 has a thickness of between 20-60 mm and the door leaf 112 has a thickness of between 10-50 mm. The protrusions 120 typically have a length of between 20-60 mm.

The locking flange 110 will typically engage with all of locking beams 114, 116, 118 once the door leaf 112 is in its fully closed position. Thus, the locking flange 110 on three sides of the door 108 will typically be "inserted" between the beam flanges of the respective locking beams 114, 116, 118.

As is illustrated in FIGS. 2*d* and 2*e*, on the fourth side of the door 108 the door leaf 112 is provided with corresponding protrusions 122; typically have a length of between 40-100 mm. A fourth locking beam 124 is affixed/joined to the corresponding side of the locking flange 110, i.e. rather than joining the protrusions 122 of the door leaf 112 to the locking beam 124, the locking beam 124 is joined (for example welded) to the locking flange 110. Corresponding openings are provided at the locking beam 124 for allowing the protrusions 122 to be inserted there through.

Thus, once the door leaf 112 is in its fully closed position, all sides of the door leaf 112 will have protrusions 120, 122 engaged through corresponding openings within the locking beams 114, 116, 118, 124, where the locking beams 114, 116, 118, 124 in turn clasps (extends over) the locking flange 110.

In case an explosive device 126 placed inside of the blast-resistant container 100 would explode, the locking flange 110 is subjected to only a small stress since the main load which occurs in the interior of the chamber 102 in the event of the explosion is taken up by the locking beams 114, 116, 118, 124. In addition, since the protrusions 120, 122 are extending through the locking beams 114, 116, 118, 124, and joined at their respective outsides (see e.g. the detailed illustration of FIG. 3), the door leaf 112 will at its connection to the locking flange 110 mainly be exposed to a tensile load.

This can be compared to a case where no protrusions 120, 122 are provided and the door leaf 112 would be directly joined to the locking beams 114, 116, 118, 124, resulting in a main exposure to a shear load. Selecting an implementation resulting in a main exposure to a tensile load has shown to be superior in regards to a blast-resistant container 100 of the disclosed type.

In addition, the disclosed implementation with protrusions 120 extending through the locking beams 114, 116, 118 requires less effort in regards to manufacturing of the blast-resistant container 100.

Further to the above discussion, the blast-resistant container 100 is provided with a door support 128 configured to receive the door 108 in the open position. The door support is typically hinged 130 to the main body 104 of the chamber 102. Thus, once the door 108 is to be opened, the door support 128 is placed perpendicular to the side of the main body 104 such that the door 108 may slide over to the door support 128. The door support 128 may then be turned such that the door 108 is placed lateral to the main body 108, thus allowing a simplified storage of the door 108 in the opened position.

The door support 128 as well as the locking flange 110 may be provided with sliding rails 132, 134 reducing the friction when sliding the door between the open and the closed position. Brackets 136 configured to engage with the sliding rails are typically affixed to the locking beam 114.

As is shown in FIG. 2*c*, for providing a further secure locking between the door 108 and the chamber 102, a locking mechanism 138 may be provided. The locking mechanism 138 may for example be arranged together with the fourth locking beam 124, and comprising a mechanism configured to selectively engage with the protrusions 122. Accordingly, the locking mechanism 138 may be selectively transitioned from an unlocked to a locked position.

Furthermore, for providing the blast-resistant container 100 with mobility, the chamber 102 may be joined to a carriage 140. The carriage 140 may be of any type or form, typically provided with a towbar connection 142 for connecting the now mobile blast-resistant container 100 to a vehicle for swift transportation away from any personnel in potential danger due to the possible explosive device 126 securely stowed away inside of the closed blast-resistant container 100.

In summary, the present invention relates to a blast-resistant container, comprising a chamber having an opening, the chamber configured to receive an explosive device and being constructed from a material configured to safely contain fragments and a blast pressure in case of explosion of the explosive device, and an external door configured to cover the opening in a closed position and to allow access to the inside of the body in an open position, the door comprising a door leaf having an upper first door side and a second lower door side provided at a circumference of the door leaf, the second door side being essentially opposite to the first door side, wherein the opening is provided with an angled locking flange arranged at an upper first opening side and a lower second opening side provided at a circumference of the opening, the second opening side being essentially opposite to the first opening side, and the first and the second door sides are provided with locking elements angled in an opposite direction to the locking flanges and configured to allow corresponding engagement with the locking flanges at the first and the second opening sides, respectively, allowing the door to slide from the open position to the closed position.

In accordance with the present invention, there is provided an explosion resistant container suitable for containing the effects of a bomb explosion within the container. The container includes a chamber and an externally arranged door that can slide from an open to a closed position. The container is manufactured from an explosion resistant material, typically a metal material, having an opening configured to receive the possible bomb, and as mentioned, configured to be covered by the door.

Although the figures may show a specific order of method steps, the order of the steps may differ from what is depicted. Also two or more steps may be performed concurrently or with partial concurrence. Such variation will depend on designer choice. All such variations are within the scope of the disclosure. Additionally, even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims.

Furthermore, in the claims, the word "comprising" does not exclude other elements or steps, and the indefinite article "a" or "an" does not exclude a plurality.

The invention claimed is:

1. A blast-resistant container, comprising:

a chamber having an opening, the chamber configured to receive an explosive device and being constructed from a material configured to safely contain fragments and a blast pressure in case of explosion of the explosive device; and an external door configured to cover the opening in a closed position and to allow access to the inside of the chamber in an open position, the door comprising a door leaf having an upper first door side and a second lower door side provided at a perimeter of the door leaf, the second door side being essentially opposite to the first door side, wherein the opening is provided with an angled locking flange arranged at an upper first opening side and a lower second opening side provided at a perimeter of the opening, the second opening side being essentially opposite to the first opening side, and the first and the second door sides are provided with locking elements angled in an opposite direction to the locking flanges and configured to allow corresponding engagement with the locking flanges at the first and the second opening sides, respectively, allowing the door to slide from the open position to the closed position, wherein the locking elements provided at the first and the second door sides are formed from separate elongated structural material fixed parallel to the first and the second door sides, and wherein the door leaf is provided with a plurality of teeth shaped protrusions at the first and the second door sides at the perimeter of the door leaf, and the elongated locking elements provided at the first and the second door sides are provided with correspondingly arranged openings for receiving the plurality of teeth shaped protrusions.

2. The blast-resistant container according to claim 1, further comprising a door support configured to receive the door leaf in the open position.

3. The blast-resistant container according to claim 1, wherein the plurality of teeth shaped protrusions and the door leaf are formed from a single sheet metal element.

4. The blast-resistant container according to claim 1, wherein the door leaf is provided with a third and a fourth vertical side, the third and the fourth sides are provided with a further plurality of teeth shaped protrusions formed at the perimeter of the door leaf, and a further elongated locking element is fixed at the third door side, the further elongated locking element having correspondingly arranged openings for receiving the plurality of teeth shaped protrusions of the third side of the door leaf.

5. The blast-resistant container according to claim 1, wherein the angled locking flange provided at the opening is formed from separate structural elements and being fixed to the chamber.

6. The blast-resistant container according to claim 5, wherein the angled locking flange is welded to the opening.

7. The blast-resistant container according to claim 1, the blast-resistant container being configured to have six rectangular sides, wherein the door leaf forms one of said six rectangular sides.

8. The blast-resistant container according to claim 1, wherein the chamber is constructed from a sheet metal element having a thickness of at least 20 mm.

9. The blast-resistant container according to claim 4, further comprising a locking arrangement fixed to a vertical side of the door opening corresponding to the fourth vertical side of the door leaf, and configured to engage with the plurality of teeth shaped protrusions formed at the fourth vertical side of the door leaf when the door is arranged in the closed position.

10. The blast-resistant container according to claim 1, further comprising a sliding rail fixed at the second opening side and configured to reduce an amount of friction when sliding the door between the opened and the closed position.

11. The blast-resistant container according to claim 1, wherein the blast-resistant container is mobile.

12. The blast-resistant container according to claim 11, wherein the chamber is affixed to a carriage.

13. The blast-resistant container according to claim 1, wherein the door support is hinged to the outside of the chamber.

* * * * *